US007045217B2

(12) United States Patent
Nishimura et al.

(10) Patent No.: US 7,045,217 B2
(45) Date of Patent: May 16, 2006

(54) PLATED COMPONENT FOR USE IN AN OUTDOOR ENVIRONMENT

(75) Inventors: Yasushi Nishimura, Izumi (JP); Yuzuru Uchiyama, Kaizuka (JP)

(73) Assignee: Shimano, Inc., Sakai (JP)

( * ) Notice: Subject to any disclaimer, the term of this patent is extended or adjusted under 35 U.S.C. 154(b) by 80 days.

(21) Appl. No.: 10/434,575

(22) Filed: May 8, 2003

(65) Prior Publication Data

US 2003/0235699 A1 Dec. 25, 2003

(30) Foreign Application Priority Data

May 9, 2002 (JP) ..... 2002-134412

(51) Int. Cl.
*B32B 15/04* (2006.01)
*A01K 89/00* (2006.01)

(52) U.S. Cl. ..... 428/457; 428/209; 428/908.8; 428/469; 428/472.2; 428/701; 428/702; 428/446; 428/654; 428/640; 428/650; 242/322; 242/323; 242/611.1

(58) Field of Classification Search ..... 428/209, 428/457, 908.8, 469, 472.2, 701–702, 446, 428/650, 654, 640; 242/322–323, 611.1
See application file for complete search history.

(56) References Cited

U.S. PATENT DOCUMENTS

| | | | | |
|---|---|---|---|---|
| 4,980,203 | A | 12/1990 | Dabosi et al. | |
| 5,056,630 | A * | 10/1991 | Fujii et al. | 188/24.13 |
| 5,582,863 | A | 12/1996 | Textor et al. | |
| 5,961,752 | A * | 10/1999 | Bergsma | 148/550 |
| 5,980,602 | A * | 11/1999 | Carden | 75/236 |

FOREIGN PATENT DOCUMENTS

| | | | |
|---|---|---|---|
| EP | 381511 | A1 | 8/1990 |
| EP | 1059123 | A2 | 12/2000 |
| JP | 08-230406 | * | 9/1996 |
| JP | 2001241474 | * | 9/2001 |

OTHER PUBLICATIONS

Patent Abstracts of Japan, vol. 011, No. 365 (C-460), dated Nov. 27, 1987 for JP 62-136577, published Jun. 19, 1987.

* cited by examiner

*Primary Examiner*—Ling Xu
(74) *Attorney, Agent, or Firm*—James A. Deland

(57) ABSTRACT

A plated component used in an outdoor environment comprises a component main unit, a metal coating formed over at least a part of the component main unit, and an oxide coating formed over at least a part of the component main unit.

24 Claims, 6 Drawing Sheets

PLATED COMPONENT FOR USE IN AN OUTDOOR ENVIRONMENT

BACKGROUND OF THE INVENTION

The present invention is directed to a plated component and, more particularly, to a plated component used in an outdoor environment.

In order to achieve light weight and a high-quality appearance, fishing components, bicycle components, and other components that are intended to be used in an outdoor environment often are made from an aluminum alloy, a magnesium alloy or a synthetic resin with resin plating. In a component made of aluminum alloy, the component usually is molded using a die-cast forming or squeeze-cast forming. These types of forming processes allow complex shapes to be formed at low cost. Where such forming processes are used, a large quantity of silicone is added to the aluminum alloy in order to increase the flowability of the molten aluminum. An Alumite coating is often formed over the surface of the aluminum alloy component in order to increase the corrosion resistance of the component and to improve its appearance. In a component made of a magnesium alloy, an anodic oxide coating often is formed on the surface of the component in order to improve corrosion resistance, and a corrosion-resistant coating is further formed on the surface by painting or by some other method. In a component made of synthetic resin, a coating often is formed on the surface of the component using a physical deposition method such as ion plating or sputtering.

When aluminum alloy is used to form the component and a large amount of silicone is added to the aluminum, flow marks become conspicuous or the color becomes gray. These features tend to dull the surface color. Even if cutting is carried out in order to prevent such effects, it is difficult to control the cutting process. As a result of such cutting, flow marks are still apparent after an Alumite coating is applied, and the luster of the surface changes at the border between chilled layers and non-chilled layers. Consequently, even where an Alumite coating is used, a high-quality external appearance with a metallic luster is difficult to obtain in a variety of colors.

When a magnesium alloy is used to form the component, any anodic oxide coating becomes white, green or brown depending on the anodic oxidation process used. As a result, it is difficult to obtain a metallic appearance for the alloy material, and high-quality external appearance with a metallic luster is difficult to obtain in a variety of colors. One possible countermeasure that attempts to prevent this phenomenon is to form a chrome coating on top of the anodic oxide coating via physical deposition and then apply decorative paint over the chrome coating. While a metallic luster can be obtained from the chrome coating, the desired hardness is not achieved because of the painted surface, and the surface is susceptible to damage.

When a synthetic resin is used to form the component, because metal plating is formed on the surface of the resin component, the surface color is limited to the color of the plated metal. Here as well, it is difficult to obtain a high-quality, lustrous metal appearance in a variety of colors.

SUMMARY OF THE INVENTION

The present invention is directed to various features of a plated component. In one embodiment, a plated component used in an outdoor environment comprises a component main unit, a metal coating formed over at least a part of the component main unit, and an oxide coating formed over at least a part of the component main unit. Additional inventive features will become apparent from the description below, and such features alone or in combination with the above features may form the basis of further inventions as recited in the claims and their equivalents.

DETAILED DESCRIPTION OF THE EMBODIMENTS

Figure 1:
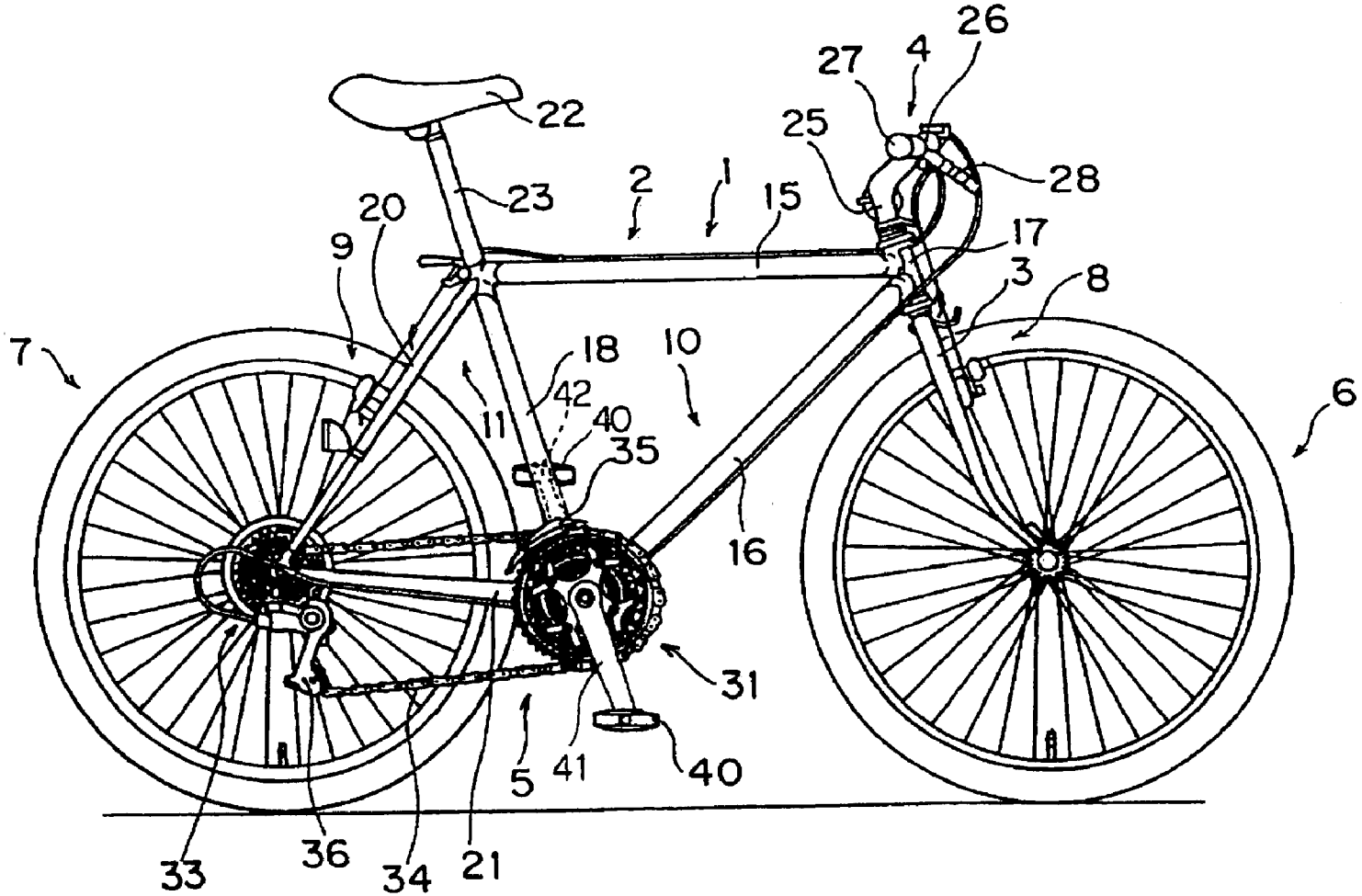
FIG. 1 is a side view of a particular embodiment of a bicycle that includes a particular embodiment of a plated component.

FIG. 1 is a side view of a particular embodiment of a bicycle that includes a particular embodiment of a plated component. In this embodiment, the bicycle is an MTB type of bicycle that includes a diamond-shaped frame 1 comprising a frame body 2 formed from aluminum tubes connected via Tig welding, for example, and a front fork 3 that is rotatably mounted to the front of the frame body 2. Fork 3 is mounted to frame body 2 such that it can rotate around an axis that is essentially vertical but angled somewhat relative to the bicycle body, and it is divided into two arms at the bottom part thereof. The MTB further includes a handlebar unit 4 that is linked to the front fork 3, a drive unit 5 that is mounted to the lower part of the frame body 2 and converts pedaling by the rider into drive power, a front wheel 6 that is rotatably supported by the bottom ends of the front fork 3, a rear wheel 7 that is rotatably supported by the rear part of the frame body 2, and front and rear brake devices 8 and 9.

The frame body 2 has a front triangle 10 and a rear triangle 11 that is disposed behind the front triangle 10. The front triangle 10 comprises a top tube 15 that is disposed horizontally, a down tube 16 that is disposed under the top tube 15 such that it rises toward the front, a head tube 17 that connects the front ends of the top tube 15 and the down tube 16, and a seat tube 18 that extends diagonally upward and to which the rear ends of the top tube 15 and the down tube 16 are connected. A seat post 23 to which a saddle 22 is secured is mounted to the seat tube 18 such that it can be adjusted upward and downward. A bottom bracket unit (not shown) is formed at the intersection of the seat tube 18 and the down tube 16. The rear triangle 11 comprises a pair of seatstays 20 that are connected at the front ends thereof to the seat tube 18, and a pair of chain stays 21 that extend to the back of the bicycle and are connected to the rear ends of the seatstays 20.

Handlebar unit 4 includes a handlebar stem 25 that is secured to the top of the front fork 3 such that it can be adjusted upward and downward. A handlebar 26 is secured to the top end of the handlebar stem 25 and extends in the right and left directions. A grip 27 is placed over the outer circumference of each end of the handlebar 26, and a brake lever 28 that includes a speed-changing lever is mounted to the inside of either grip 27.

The drive unit 5 has a gear crank unit 31 rotatably mounted to the bottom bracket unit, a rear gear cluster 33 non-rotatably mounted to a free hub of the rear wheel 7, and a chain 34 that engages the gear crank unit 31 and the rear gear cluster 33. The gear crank unit 31 has a right gear crank 41 and a left gear crank (not shown), and a pedal 40 is mounted to the distal end of each gear crank. A crankshaft (not shown) extends through the bottom bracket unit and links the right gear crank 41 and the left gear crank. A front derailleur 35 moves the chain 34 among the gears that form a part of gear crank unit 31, and a rear derailleur 36 moves the chain 34 among the plurality gears that form the rear gear cluster 33.

Figure 2:
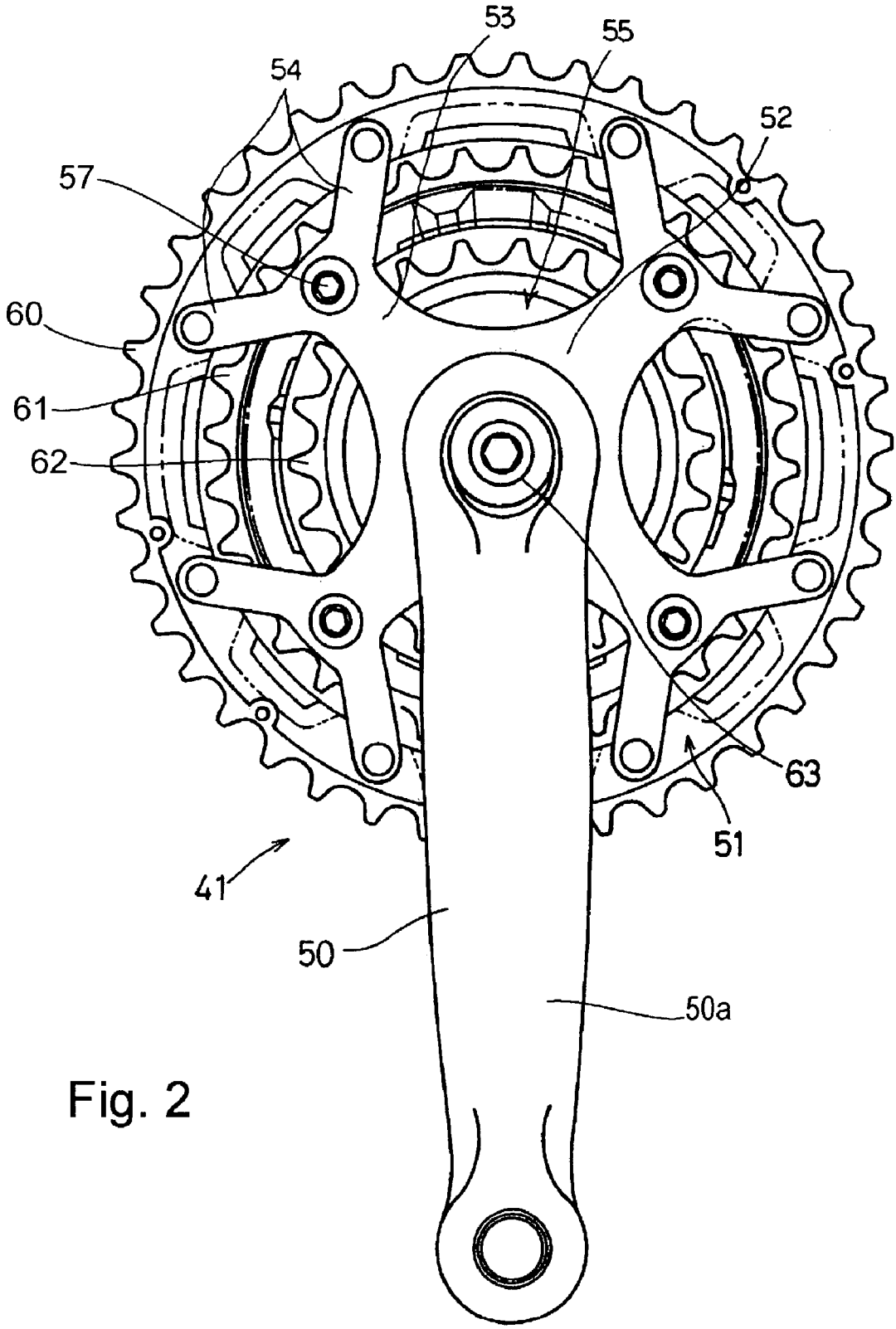
FIG. 2 is a front view of a particular embodiment of a right gear crank of the bicycle shown in FIG. 1.
Figure 3:
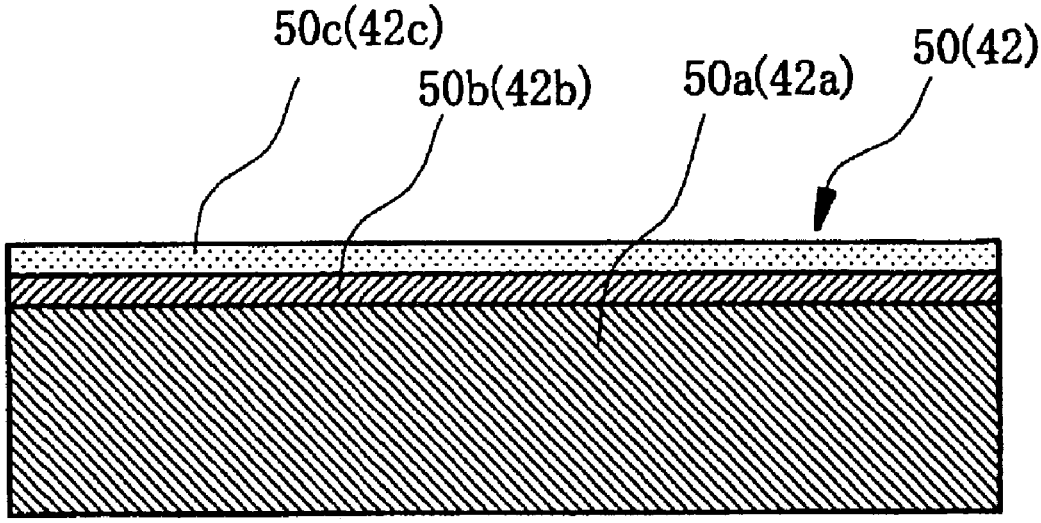
FIG. 3 is a cross-sectional view of a portion of a crank having a plated component.

As shown in FIGS. 2 and 3, the right gear crank 41 has a bar-shaped crank 50. A pedal 40 is mounted to one end of crank 50 (FIG. 1), and a gear plate 51 is non-rotatably mounted to the other end of crank 50. The crank 50 and the gear plate 51 are secured to the crankshaft in a known manner through a mounting bolt 63.

The gear plate 51 has a crank mounting member 52 with internal splines (not shown) so that crank mounting member 52 can nonrotatably engage corresponding outer splines (not shown) on crank 50. A crank arm member 55 has four arms 53 that extend radially outwardly in four directions from the crank mounting member 52. Each arm 53 has an associated pair of gear securing areas 54, each of which extend outwardly in two opposite directions at the tip of each arm 53. Mounting screw holes 57 are formed in the crank arm member 55 such that there is one such hole in each arm 53. A ring-shaped outer gear 60 is riveted to the gear securing areas 54 in eight locations, and a center gear 61 having fewer teeth than the outer gear 60 is mounted to the mounting screw holes 57 coaxially with the outer gear 60. Additionally, a mounting screw hole (not shown) used for mounting an inner gear 62 is formed on the rear surface of each arm 53.

The crank 50 is made from an aluminum alloy and has a component main unit 50*a*, an aluminum coating 50*b* (FIG. 3) that is formed on at least the surface of the main unit 50*a* that is exposed to the outdoor environment, and an Alumite coating 50*c* that is formed on top of the aluminum coating. The left crank 42 has essentially the same construction as the right crank 50, except for the gear plate 51. Accordingly, left crank 42 has a component main unit 42*a*, an aluminum coating 42*b* and an Alumite coating 42*c*.

In this embodiment, the component main unit 50*a* comprises a hollowed-out die-cast aluminum alloy. The aluminum alloy used for the component main unit 50*a* contains between 0.3 percent and 18 percent of silicone by weight. When the aluminum alloy contains this percentage of silicone, the molten aluminum alloy flows more easily and can be formed into highly precise configurations.

In this embodiment, the aluminum coating 50*b* comprises and aluminum alloy having a thickness in a range from approximately 2 μm to approximately 20 μm, for example. When the aluminum coating 50*b* is thicker than this range, it peels off easily, and when it is thinner, the Alumite coating 50*c* becomes thin and peels off easily. Coating 50*b* is formed using a conventional physical deposition method such as sputtering, vacuum deposition, ion plating, etc.

In this embodiment, the Alumite coating 50*c* is formed via anodic oxidation on top of the aluminum coating 50*b* that was formed via physical deposition. The Alumite coating 50*c* then undergoes a conventional sealing process such as vapor sealing, and it may be lightly stained with a color such as blue, for example.

The manufacturing process for the right crank 50 will now be described with reference to FIGS. 4(A)–4(C). Because the manufacturing process for the left crank 42 is identical to the process for the right crank 50, description thereof will be omitted.

Figure 4A:
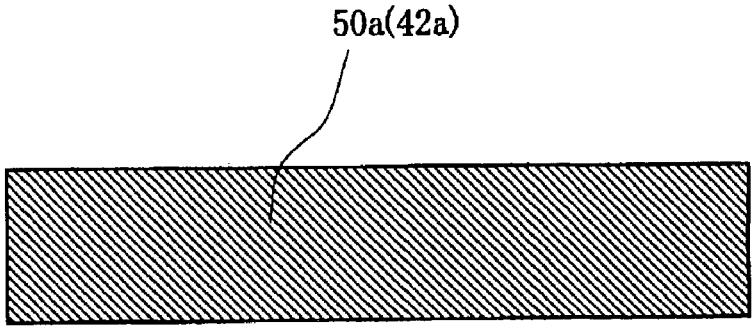
FIGS. 4(A)–4(C) are cross-sectional views illustrating a particular embodiment of a manufacturing process for a plated component.
Figure 4B:
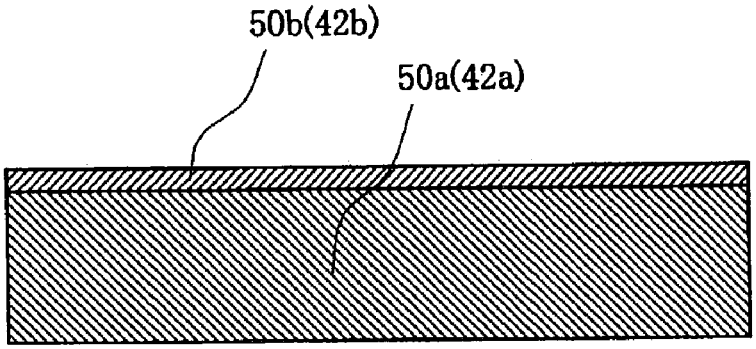
Figure 4C:
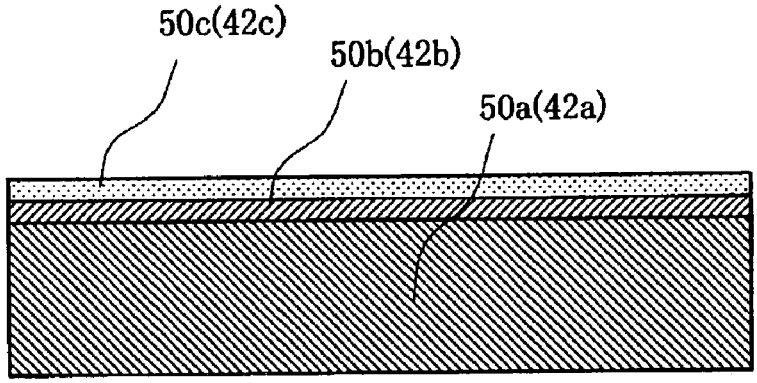

First, an aluminum alloy material formed in the shape of the component main unit 50*a* of the right crank 50 is prepared using die-cast forming, as shown in FIG. 4(A). Then, an aluminum coating 50*b* (e.g., pure aluminum, an aluminum alloy, etc) is formed on the exposed surface of the component main unit 50*a* as shown in FIG. 4(B) using a conventional physical deposition method. In this embodiment, an ion plating method is preferred for the formation of the aluminum coating 50*b* in order to increase adhesiveness, but the sputtering method or the vacuum deposition method may be used as well. An Alumite coating 50*c* is then formed on top of the aluminum coating 50*b* as shown in FIG. 4(C) using a conventional anodic oxidation method. If desired, the Alumite coating 50*c* may be colored a unique color via staining or electrolytic coloring. Finally, the Alumite coating 50*c* can be completely sealed, partially sealed or not sealed. Complete sealing improves corrosion resistance, while the absence of sealing improves adhesiveness. As a result, whether or not sealing is to be performed may be determined in accordance with the environment in which the component is to be used. Coloring may be carried out simultaneously with sealing.

In this embodiment, because the Alumite coating 50*c* is formed on top of the smooth surface of the aluminum coating 50*b* formed via physical deposition, the appearance of the exterior of the material comprising the component main unit 50*a* is shielded from view by the aluminum coating 50*b* and Alumite coating 50*c*. Thus, a high-quality, lustrous metal appearance can be obtained in a variety of colors without being affected by such material. Furthermore, because the Alumite coating 50*c* is formed in the manner of a ceramic, the component becomes harder and more damage-resistant.

In the previous embodiment, a plated component was described using a bicycle component as an example, but the described process also may be used for other components, such as a main unit of a fishing reel.

Figure 5:
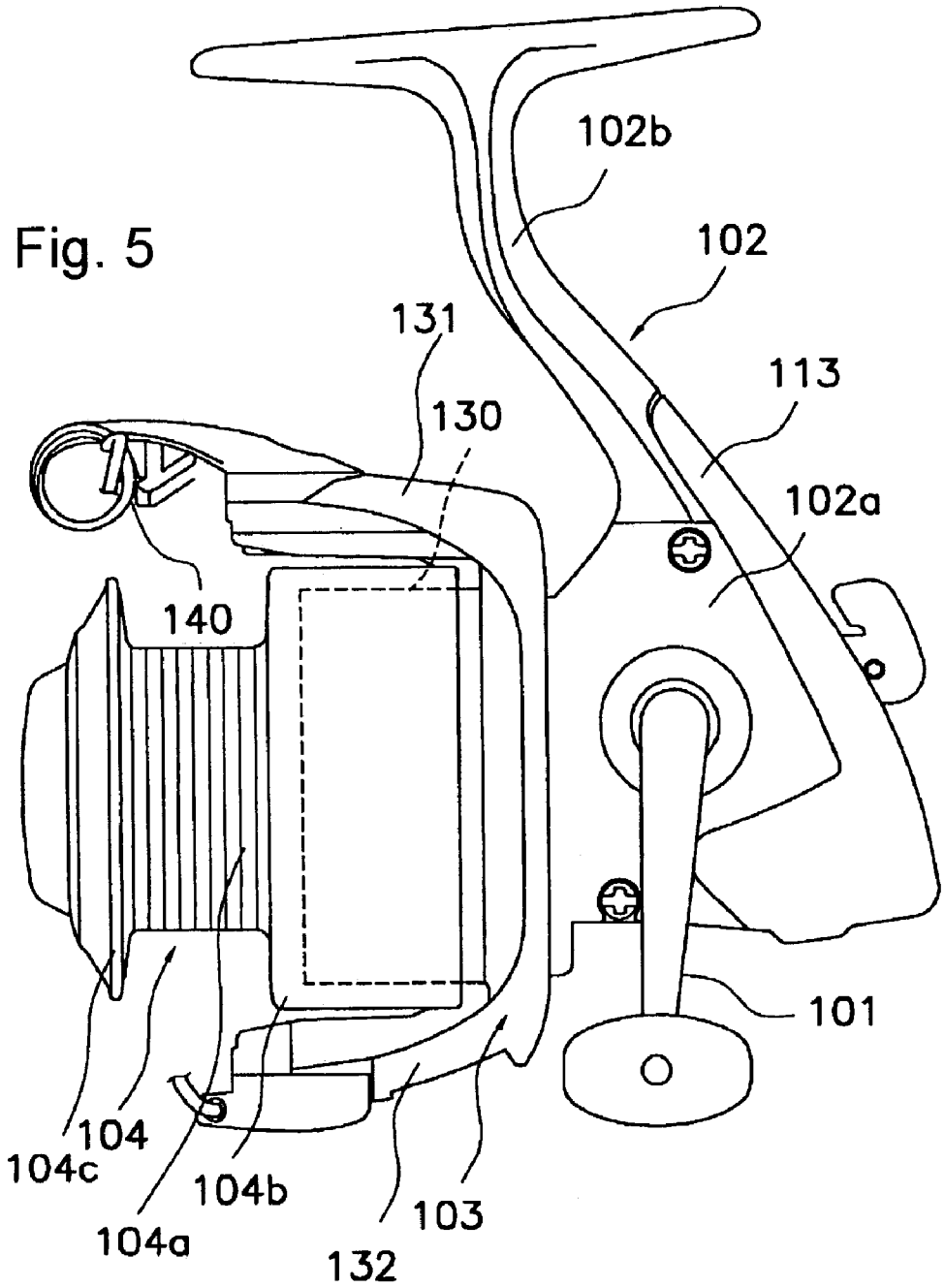
FIG. 5 is a side view of a particular embodiment of a spinning reel assembly that includes a particular embodiment of a plated component.

FIG. 5 is a side view of a particular embodiment of a spinning reel assembly that includes a particular embodiment of a plated component. The spinning reel assembly includes a handle assembly 101, a reel main unit 102 to which the handle assembly 101 is mounted such that handle assembly 101 can rotate around an axis that extends from the right to left of the reel (upwardly from the page in FIG. 5), a rotor 103, and a spool 104. The rotor 103 rotates in tandem with the rotation of the handle assembly 101 and guides the fishing line to the spool 104. Rotor 103 is rotatably supported at the front of the reel main unit 102 such that it can rotate around an axis that extends from the front to the back of the reel (to the left and right in FIG. 5). The spool 104 winds the fishing line guided by the rotor 103 around its outer circumference, and it is disposed at the front of the rotor 103 such that it can move back and forth, i.e., forward and backward, along its axis.

The reel main unit 102 has a hollow reel body 102*a* made from a magnesium alloy, for example, and a T-shaped rod mounting leg 102*b* that is also made from a magnesium alloy and that extends from the reel body 102*a* diagonally upward and toward the front as a single unit. Disposed inside the reel body 102*a* are a rotor drive mechanism (not shown) and an oscillating mechanism (not shown). The rotor drive mechanism causes the rotor 103 to rotate in tandem with the rotation of the handle assembly 101, and the oscillating mechanism moves the spool 104 forward and backward to ensure that the fishing line is taken up evenly on the spool. A protective cover 113 made of metal or synthetic resin, for example, covers the rear of the reel main unit 102. The protective cover 113 is disposed such that it extends from the bottom of reel main body 102, along the back of the reel body 102*a* to the rod mounting leg 102*b*, thereby covering the bottom and the back of the reel main unit 102. The protective cover 113 is removably secured to the reel main unit 102 using screws.

The rotor 103 has a cylindrical member 130 that is rotatably mounted to the reel main unit 102, first and second rotor arms 131 and 132 that extend forwardly from the outer circumferential surface of the back part of the cylindrical member 130 in a manner that forms a gap between rotor arms 131 and 132 and the cylindrical member 130, and a bail arm 140 that is movably mounted to both rotor arms and operates to guide the fishing line.

The spool 104 has a grooved construction, and it is disposed between the first rotor arm 131 and the second rotor arm 132. The spool 104 is linked to the distal end of a spool shaft (not shown) via a drag mechanism (not shown) that creates a drag force on the spool 104. The spool 104 has a line winding barrel 104*a*, a skirt 104*b* that is integrally formed with the back part of the line winding barrel 104*a*, and a front flange 104*c* that is disposed at the front end of the line winding barrel 104*a*. Line winding barrel 104*a* is made of lightweight aluminum alloy, for example, and it is used for winding a fishing line. The skirt 104*b* is a bottomed cylindrical member that first extends radially from the back end of the line winding barrel 104*a* and then extends straight backward such that it covers the cylindrical member 130 of the rotor 103.

Figure 6:
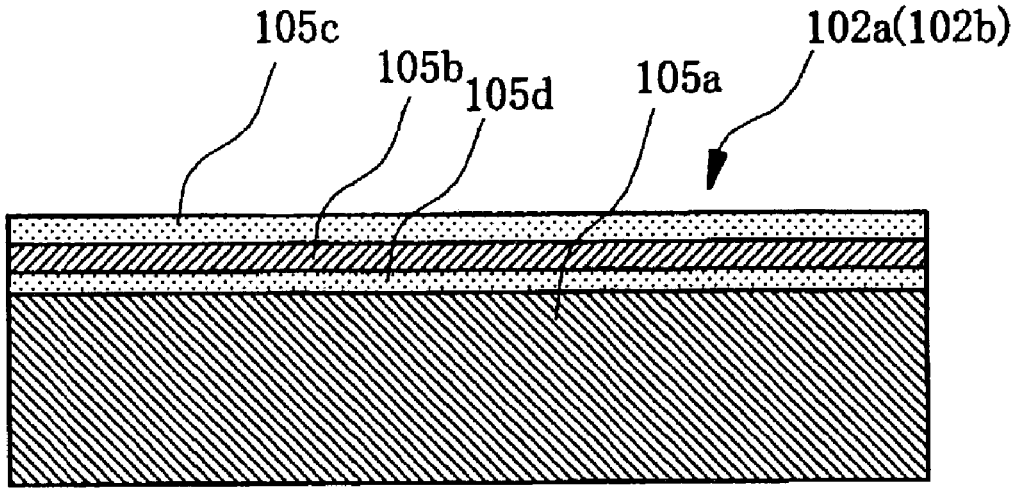
FIG. 6 is a cross-sectional view of a portion of the spinning reel assembly having a plated component.

The reel body 102*a* and rod mounting leg 102*b* include, as shown in FIG. 6, a component main unit 105*a* made from magnesium alloy, a magnesium oxide coating (anodic oxide coating) 105*d* formed on the exposed surface of the component main unit 105*a*, an aluminum coating 105*b* formed on top of the magnesium oxide coating 105*d*, and an Alumite coating 105*c* formed on top of the aluminum coating 105*b*. The aluminum coating 105*b* and the Alumite coating 105*c* are identical to the corresponding coatings described in connection with the first embodiment. One difference between this embodiment and the first embodiment is that an anodic oxide coating 105*d* is formed on the surface of the component main unit 105*a*. Because magnesium alloy corrodes more easily that aluminum alloy, the magnesium oxide coating 105*d* is formed on top of the component main unit 105*a* in order to improve corrosion resistance.

Because the component main unit 105*a* is made from magnesium alloy, it can be made very lightweight. Also, since an anodic oxide coating 105*d* is formed on the surface of the magnesium alloy, the adhesiveness of the aluminum coating 105*b* is increased and corrosion resistance is improved. Because the reel main unit 102 of the spinning reel has an Alumite coating 105*c* formed via physical deposition on top of the smooth surface of the aluminum coating 105*b*, the appearance of the exterior of the material comprising the component main unit 105*a* is shielded from view by the aluminum coating 105*b* and Alumite coating 105*c*. Thus, a high-quality, lustrous metal appearance can be obtained in a variety of colors without being affected by the component main unit 105*a*. Also, because the Alumite coating 105*c* is formed ceramic-like, the component main unit 105*a* becomes harder and more damage-resistant.

While the above is a description of various embodiments of inventive features, further modifications may be employed without departing from the spirit and scope of the present invention. For example, different metals and oxide coatings as well as synthetic resins may be used in place of the materails specifically described. In the case of a component main unit made of synthetic resin, it is acceptable if an aluminum coating is formed on the synthetic resin component main unit and an Alumite coating is formed on top of the aluminum coating.

In the above embodiments, a bicycle crank or the main unit of a spinning reel was described as an example of the component exposed to an outdoor environment, but the present invention is not limited to these examples. The teachings herein may be applied to a different component, such as a gear shift mechanism, a brake lever, a wheel hub or rim of a bicycle, a spool or rotor of a fishing reel, and so on.

The size, shape, location or orientation of the various components may be changed as desired. Components that are shown directly connected or contacting each other may have intermediate structures disposed between them. The functions of one element may be performed by two, and vice versa. The structures and functions of one embodiment may be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the scope of the invention should not be limited by the specific structures disclosed or the apparent initial focus or emphasis on a particular structure or feature.

What is claimed is:

1. A plated component used in an outdoor environment comprising:

a component main unit comprising aluminum;

wherein the component main unit contains from approximately 0.3% to approximately 18% by weight of silicone added to the aluminum;

a metal coating formed over at least a part of the component main unit; and a first oxide coating formed over at least a part of the component main unit.

2. The component according to claim 1 wherein the component main unit is formed via die forming.

3. The component according to claim 1 wherein the component main unit comprises an aluminum alloy.

4. The component according to claim 1 wherein the metal coating comprises an aluminum coating.

5. The component according to claim 1 wherein the first oxide coating comprises an anodic oxide coating.

6. The component according to claim 5 wherein the metal coating comprises an aluminum coating.

7. The component according to claim 1 wherein the first oxide coating is formed over the metal coating.

8. The component according to claim 7 wherein the metal coating is formed on at least a portion of a surface of the component main unit.

9. The component according to claim 7 wherein the first oxide coating is formed on at least a portion of a surface of the metal coating.

10. The component according to claim 7 wherein the metal coating is formed on at least a portion of a surface of the component main unit, and wherein the first oxide coating is formed on at least a portion of a surface of the metal coating.

11. The component according to claim 10 wherein the component main unit comprises an aluminum alloy.

12. The component according to claim 10 wherein the first oxide coating comprises an anodic oxide coating.

13. The component according to claim 10 wherein the metal coating comprises an aluminum coating.

14. The component according to claim 13 wherein the first oxide coating comprises an anodic oxide coating.

15. The component according to claim 1 wherein the first oxide coating comprises an anodic oxide coating.

16. The component according to claim 1 wherein the metal coating is formed using a physical deposition method.

17. The component according to claim 16 wherein the physical deposition method comprises sputtering.

18. The component according to claim 16 wherein the physical deposition method comprises vacuum deposition.

19. The component according to claim 16 wherein the physical deposition method comprises ion plating.

20. The component according to claim 1 wherein the component main unit comprises a bicycle component used in an outdoor environment.

21. The component according to claim 1 wherein the component main unit comprises a fishing reel component used in an outdoor environment.

22. The component according to claim 1 wherein the metal coating has a thickness of from approximately 2 μm to approximately 20 μm.

23. The component according to claim 1 wherein the first oxide coating comprises Alumite.

24. A plated component used in an outdoor environment comprising:

a component main unit comprising aluminum;

wherein the component main unit contains from approximately 0.3% to approximately 18% by weight of silicone added to the aluminum;

an aluminum coating formed by physical deposition on at least a portion of a surface of the component main unit that is exposed to the outdoor environment; and an anodic oxide coating formed on at least a portion of a surface of the aluminum coating.

* * * * *